US006581260B2

(12) United States Patent
Kinney

(10) Patent No.: US 6,581,260 B2
(45) Date of Patent: Jun. 24, 2003

(54) MACHINE AND METHOD OF SECURING FABRIC TO A CORE

(75) Inventor: Thomas M. Kinney, Wyoming, MI (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 09/982,600

(22) Filed: Oct. 17, 2001

(65) Prior Publication Data

US 2002/0046452 A1 Apr. 25, 2002

Related U.S. Application Data

(60) Provisional application No. 60/242,787, filed on Oct. 24, 2000.

(51) Int. Cl.[7] ..... B68G 7/00

(52) U.S. Cl. ..... 29/91.1; 29/91.5; 29/243.56; 29/243.57; 29/787

(58) Field of Search ..... 29/91.1, 91.5, 29/243.5, 243.56, 243.58, 779, 787, 448, 243.57; 227/12, 13, 152, 153, 154

(56) References Cited

U.S. PATENT DOCUMENTS

| | | | | |
|---|---|---|---|---|
| 1,927,849 A | | 9/1933 | Roberts | 26/63 |
| 3,086,209 A | | 4/1963 | Kamborian | 1/60 |
| 3,527,397 A | | 9/1970 | Wortsmith | 227/13 |
| 3,637,121 A | | 1/1972 | Alexeff | 226/17 |
| 3,650,000 A | | 3/1972 | Alexeff et al. | 26/65 |
| 3,699,626 A | * | 10/1972 | Roth | 29/798 |
| 3,838,481 A | | 10/1974 | Kuroda | 26/67 |
| 3,840,167 A | | 10/1974 | Otteman et al. | 227/76 |
| 4,382,343 A | | 5/1983 | Chahanian | 38/102.91 |
| 4,630,364 A | * | 12/1986 | Fyfe et al. | 29/779 |
| 4,659,001 A | * | 4/1987 | Herten | 227/153 |
| 4,856,171 A | * | 8/1989 | Croteau | 29/417 |
| 4,995,178 A | | 2/1991 | Randolph | 38/102 |
| 5,014,408 A | | 5/1991 | Radermacher | 29/243.58 |
| 5,058,794 A | | 10/1991 | Stanton | 227/7 |
| 5,072,496 A | | 12/1991 | Radermacher | 29/91.1 |
| 5,129,569 A | | 7/1992 | Stanton | 227/43 |
| 5,715,638 A | * | 2/1998 | Anderson, Sr. | 52/506.08 |
| 5,794,328 A | * | 8/1998 | Simone | 29/709 |
| 6,499,203 B2 | * | 12/2002 | Morello | 29/243.58 |

* cited by examiner

*Primary Examiner*—Gregory Vidovich
*Assistant Examiner*—Essama Omgba
(74) *Attorney, Agent, or Firm*—Brinks Hofer Gilson & Lione

(57) ABSTRACT

A machine and method for securing fabric layers to the core of a fabric panel. The machine includes top rollers and side rollers for stretching the fabric layers along the top surface and side surfaces of the core. Staplers preserve the stretch by stapling the edge of the fabric to the side surfaces. A front stapler and rear stapler are also provided for stapling the fabric to the rear surface and front surface of the core.

50 Claims, 13 Drawing Sheets

MACHINE AND METHOD OF SECURING FABRIC TO A CORE

This application claims priority under 35 U.S.C. §119(e) to provisional application No. 60/242,787, filed Oct. 24, 2000, which is hereby incorporated by reference herein.

BACKGROUND

The present invention relates generally to fabric panels, and more particularly, to a machine for attaching fabric to a core.

Fabric panels are a well-known piece of furniture that are typically used in office areas to create individual work spaces. Work spaces using fabric panels have been widely adopted by office designers because of the many advantages that these work spaces offer over traditional office designs. One advantage of fabric panel work spaces is the greater flexibility that is available to office designers. Thus, office designers can easily tailor an entire office area to the unique needs of a group of workers. For instance, the size of the individual work spaces can be modified in size to fit the available office area. Convenient aisle pathways can also be designed between the work spaces. Work spaces can also be designed in larger configurations in which several workers share the same work space. In addition, the fabric panels can be manufactured with integral storage cabinets and desks to provide even greater flexibility.

A significant advantage of fabric panel work spaces is the ease with which they can be reconfigured. This flexibility allows office designers to quickly and inexpensively modify an entire office area when the needs of the workers change. By comparison, this type of flexibility is a significant improvement over traditional office designs, which are typically expensive and time-consuming to modify since permanent walls must be torn down and rebuilt.

Work spaces provide workers with a higher level of privacy than is available in traditional unwalled, open office areas. In addition, the fabric panels reduce visual distractions and lower the ambient noise in an office area. Thus, the workers are able to work more comfortably and can concentrate more fully on their work.

Because of the many advantages of fabric panel work spaces, the market demand for fabric panels remains consistently high. The demand for quality manufacturing also remains high. Another market trend that appears to be increasing is the desire for more variety in the fabric panels. For instance, one area that is of particular interest is the type of outer fabric that is secured onto the panels. Increasingly, office designers prefer unique colors and fabric textures in order to distinguish an office area from other office areas.

These demands have made it difficult for traditional manufacturing operations to keep pace with increasing expectations and changing needs. For example, in order to meet the increased demand for fabric panels, manufacturers must raise production volumes while maintaining high quality standards for the fabric panels. At the same time, manufacturers desire to minimize the manpower required for production in order to minimize costs. In addition, the manufacturing operations must be flexible so that a variety of different styles of fabric panels can be produced quickly and easily.

Generally, fabric panels have been manufactured in a largely manual operation. Typically, this manual operation involves two operators working together around a support table. The operators first lift a core and position it onto the support table. Next, the operators place a number of fabric layers onto the top surface of the core and visually align the fabric layers to the core. Typically, the fabric includes excess material along the edges of the fabric so that the operators can insert the excess edge material into clamps positioned along the side, front, and bottom surfaces of the core. The clamps then grasp and stretch the fabric. While the fabric is stretched, the operators staple the edges of the fabric to both sides and front and rear surfaces of the core. Typically, a manual stapler is used with a guide that contacts the top surface of the panel to provide height location for the stapling. Finally, the operators release the clamps and trim the excess fabric from the panel. Usually, this process is repeated at a second station, where fabric is secured to the other side of the core.

This type of manual operation, however, is not well-suited for high volume production of fabric panels because of the large manpower requirements. The quality of the fabric panels also tends to become poorer as the operators tire and become fatigued. One quality criteria that sometimes suffers is the alignment of the outer fabric layer to the core. Proper alignment of the outer fabric layer is especially important because the threads in the fabric are usually visible to office workers. Thus, fabric panels with threads that are aligned almost perfectly vertical and horizontal, as compared to crooked, are preferred. Alignment of the fabric threads is often a problem with manual operations because the operators usually align the fabric to the core with a simple visual alignment. Office workers also prefer the appearance of fabric panels that have a consistent stretch across the entire surface of the fabric. However, inconsistent stretching can be a problem if the operators are not consistent from panel to panel when clamping the fabric. Another problem with manual operations is inconsistency in the stapling. Typically, a spacing of 0.125 inch is preferred between each of the staples. However, because the operators manually staple the fabric to the core, the spacing of the staples varies as the operators vary the speed of the stapler. The manual clamping and stapling arrangement described also has the disadvantage of requiring extra excess fabric around the edges, which is wasted after the trimming process. Thus, a larger piece of fabric is necessary to provide the clamps with sufficient fabric for grasping than is actually used on the panel after stapling and trimming.

SUMMARY

Accordingly, a machine is provided for stretching and securing fabric to a core. The machine includes a first station for loading a core, aligning fabric layers to the core, and stapling the front edge of the fabric layers to the front surface of the core. A second station then stretches the fabric along the top surface of the panel with top rollers that rotate due to friction that is created between the rollers and the fabric. The top rollers are angled so that an outer end of each roller engages the fabric before an inner end of the rollers. A pair of powered side rollers then stretch the fabric along the side surfaces of the core. After the fabric is stretched, side staplers staple the fabric to the side surfaces of the core. Next, a powered roller stretches the fabric along the rear surface of the core, and a rear stapler staples the fabric to the rear surface. A brake is also provided to resist the forward force of the rear stapler. Preferably, a third station with a flipping member is provided for turning the panel over. A fourth and fifth station that are comparable to the first and second stations then secure fabric layers to the other side of the panel.

Thus, the machine provides a higher volume process for manufacturing fabric panels. In addition, the machine improves the quality of the fabric panels by providing a consistent stretch in the fabric and consistent spacing between the staples. A smaller piece of fabric can also be used since extra fabric material is not needed around the edges for the clamps. Finally, an improved method for quickly and easily aligning the fabric to the core is provided in which the edge of the fabric is aligned with a guide.

BRIEF DESCRIPTION OF SEVERAL VIEWS OF THE DRAWINGS

The invention, including its construction and method of operation, is illustrated more or less diagrammatically in the drawings, in which.

DETAILED DESCRIPTION

Figure 1:
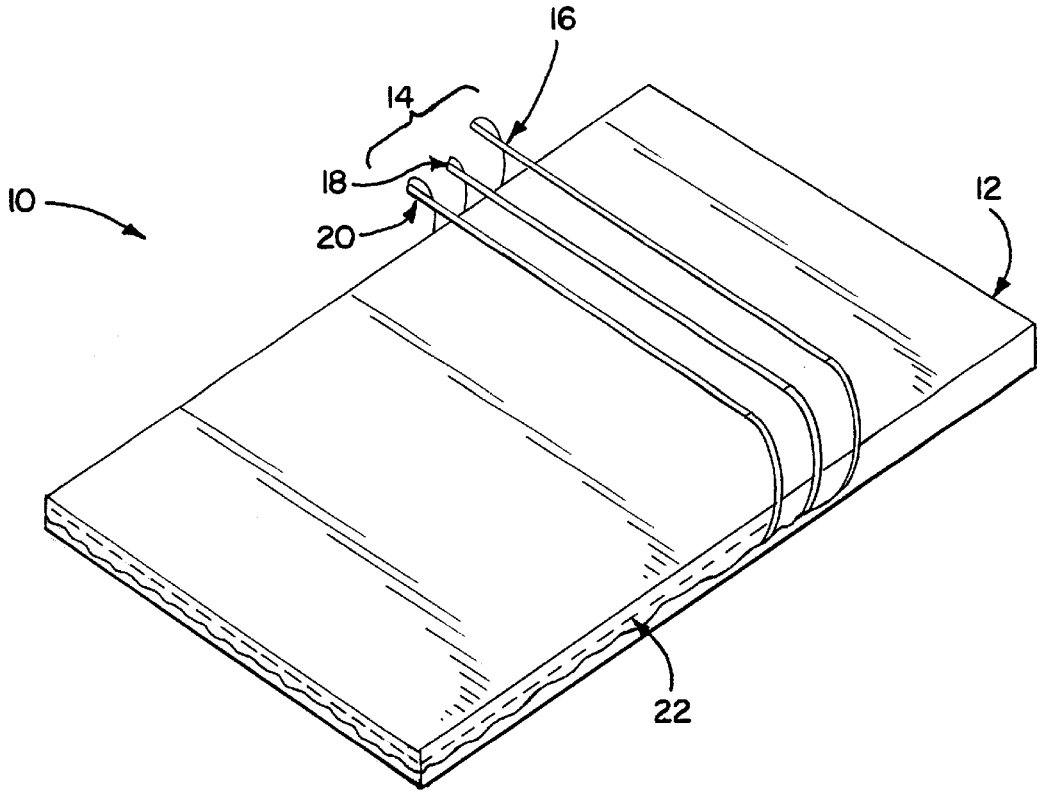
FIG. 1 is a perspective view of a fabric panel, showing fabric layers secured to a core.
Figure 2:
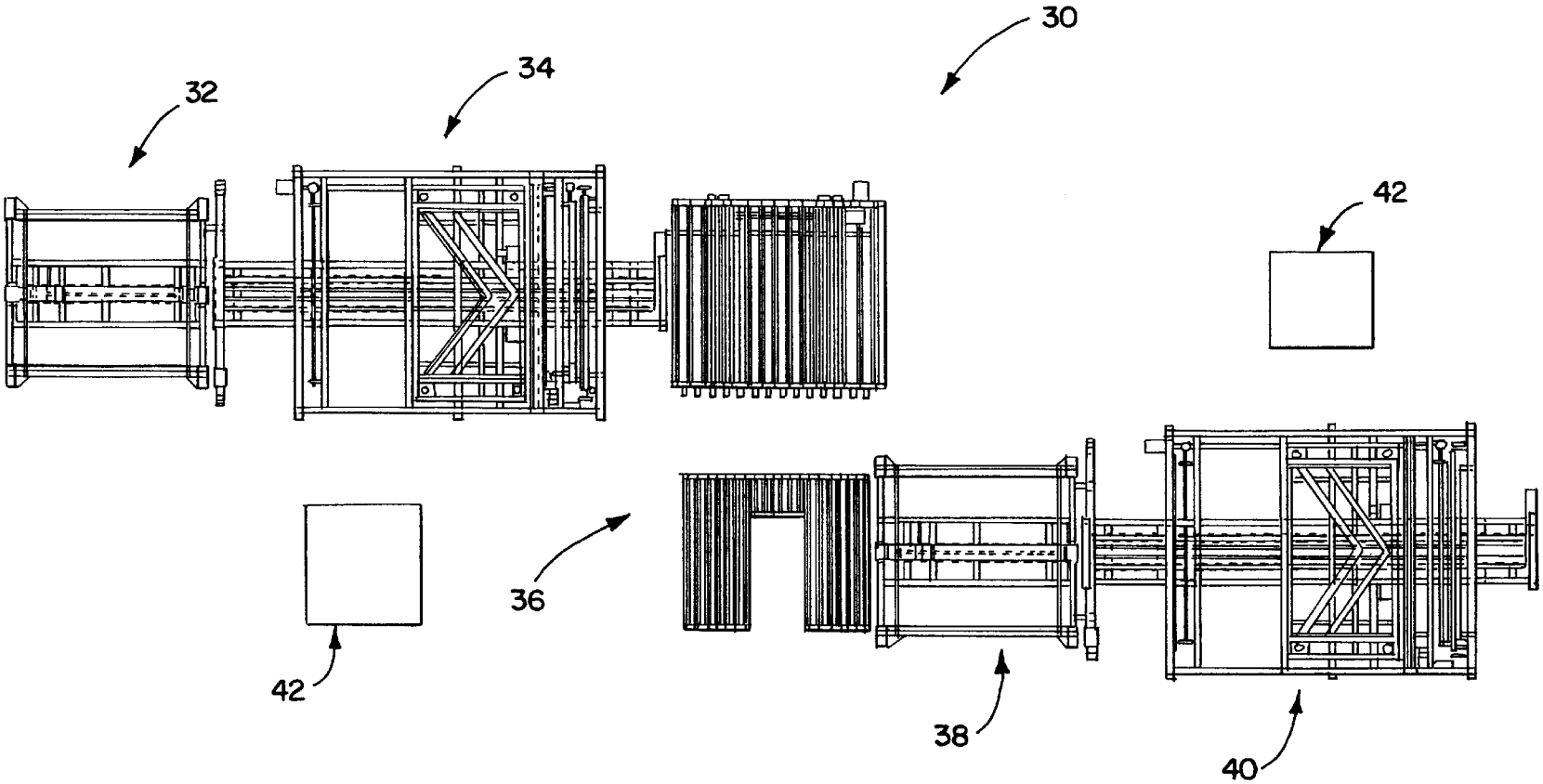
FIG. 2 is a top plan view of five stations of a machine.
Figure 3:
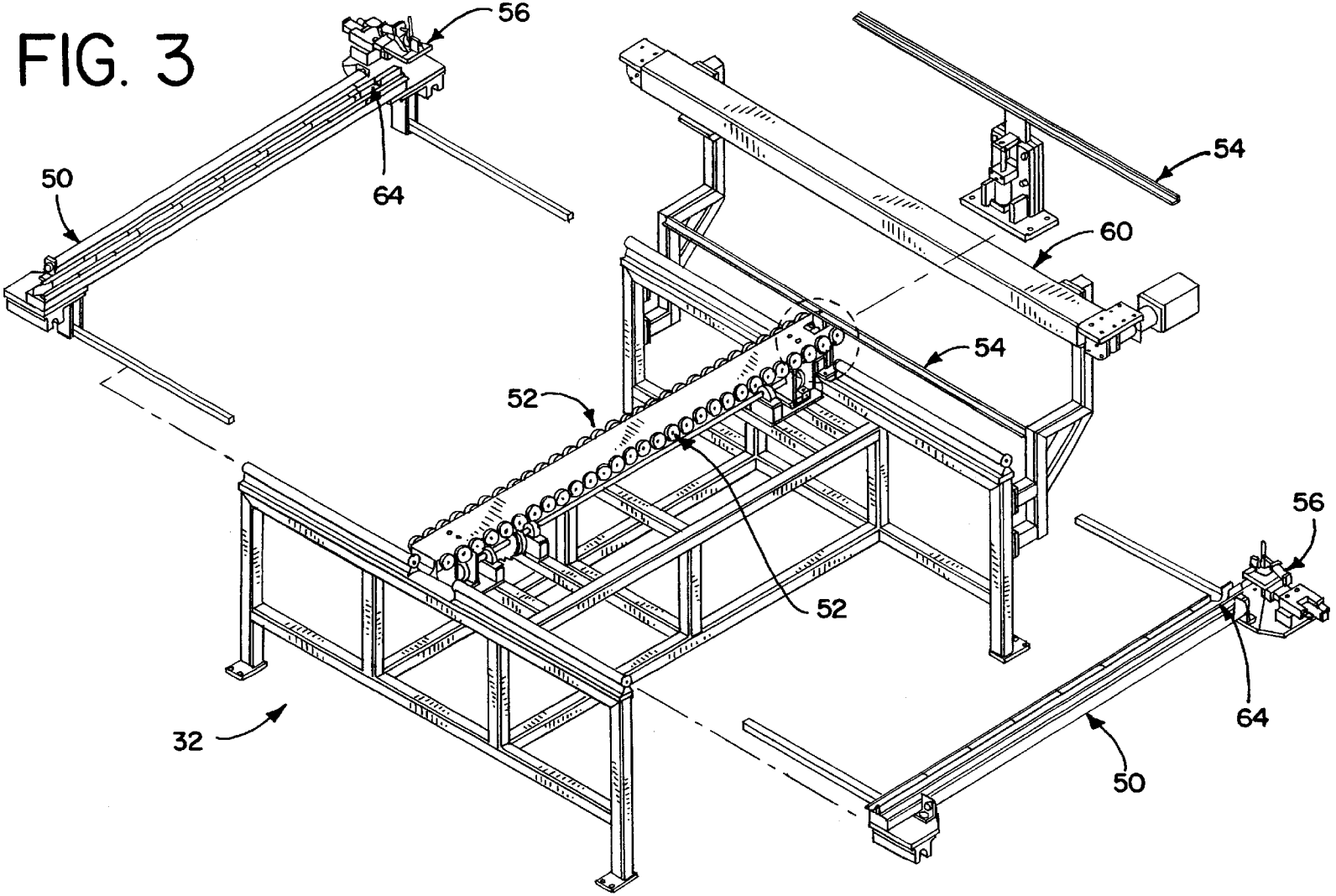
FIG. 3 is a perspective view of a first station and an alternative fourth station.
Figure 4:
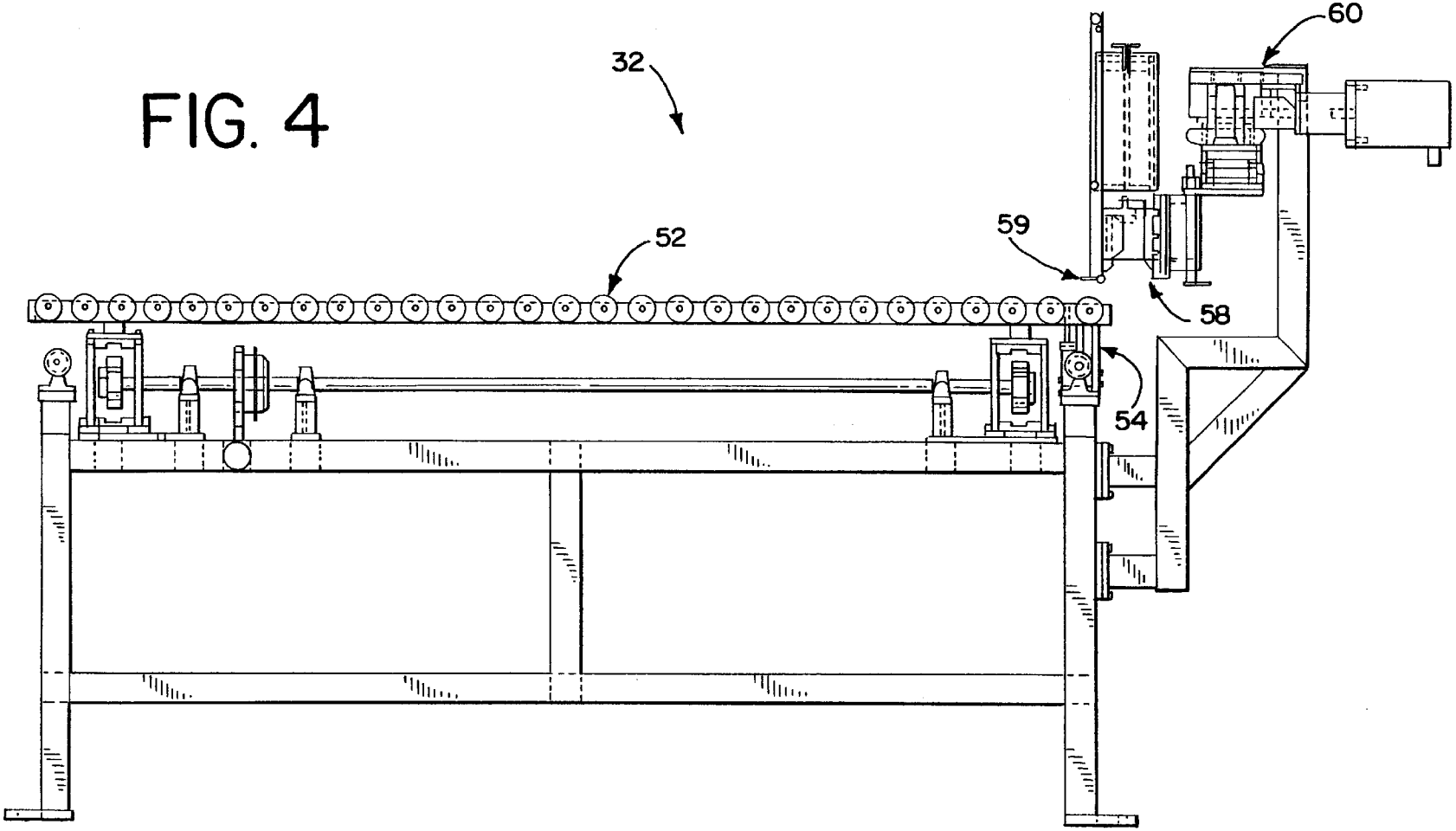
FIG. 4 is a side elevational view of the first station and the alternative fourth station.
Figure 5:
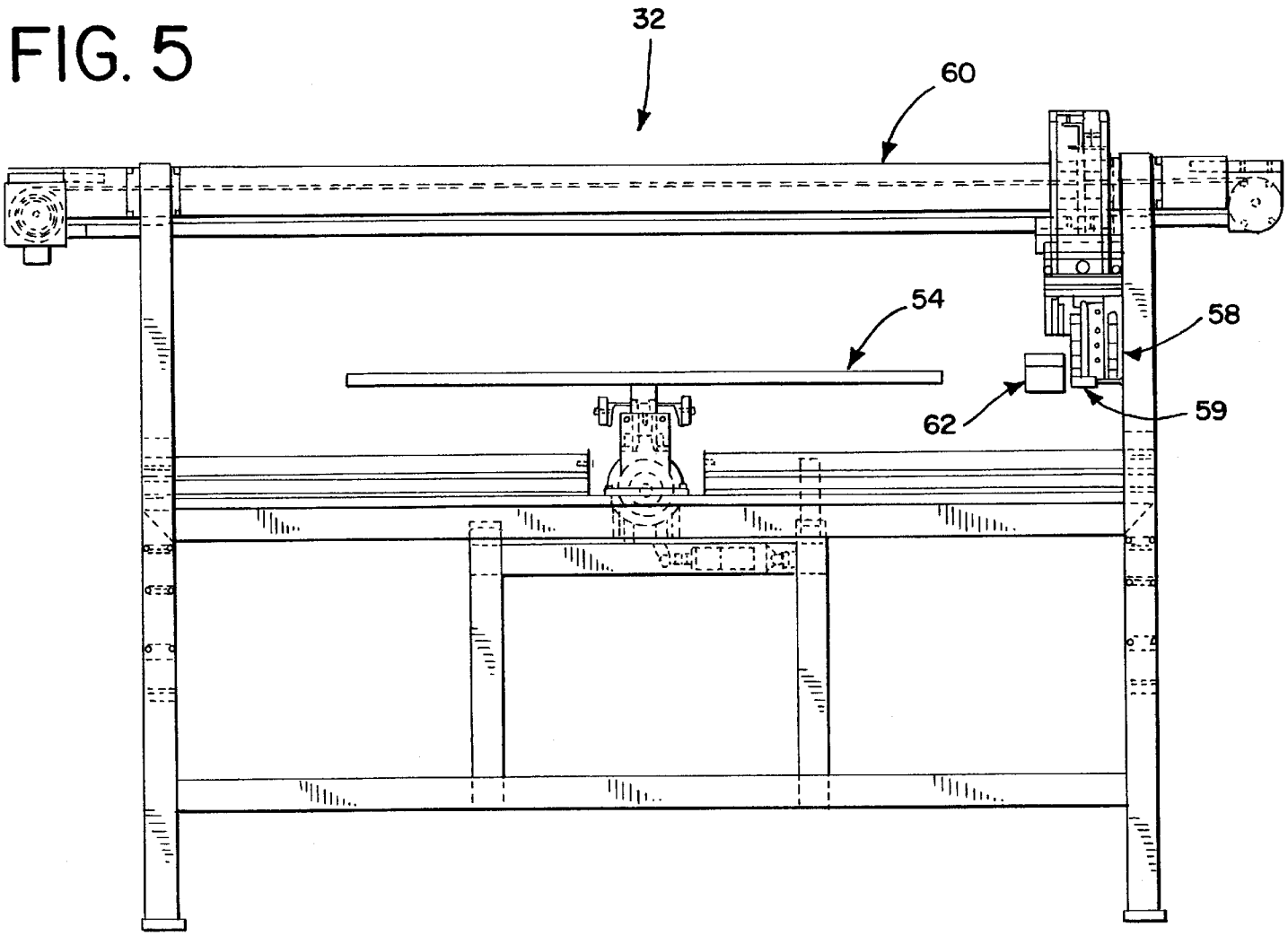
FIG. 5 is a front elevational view of the first station and the alternative fourth station.
Figure 6:
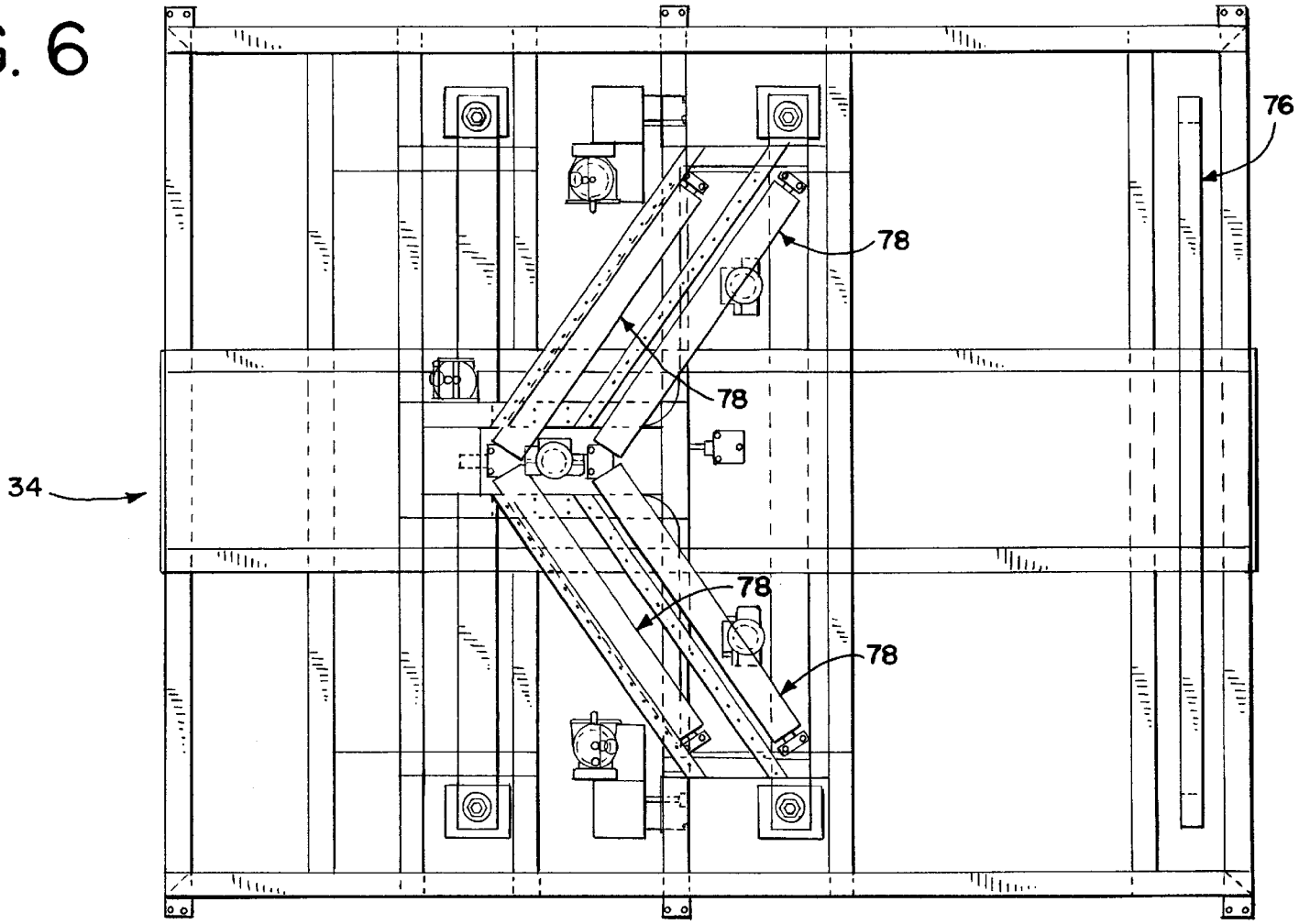
FIG. 6 is a top plan view of a second station and an alternative fifth station.
Figure 7:
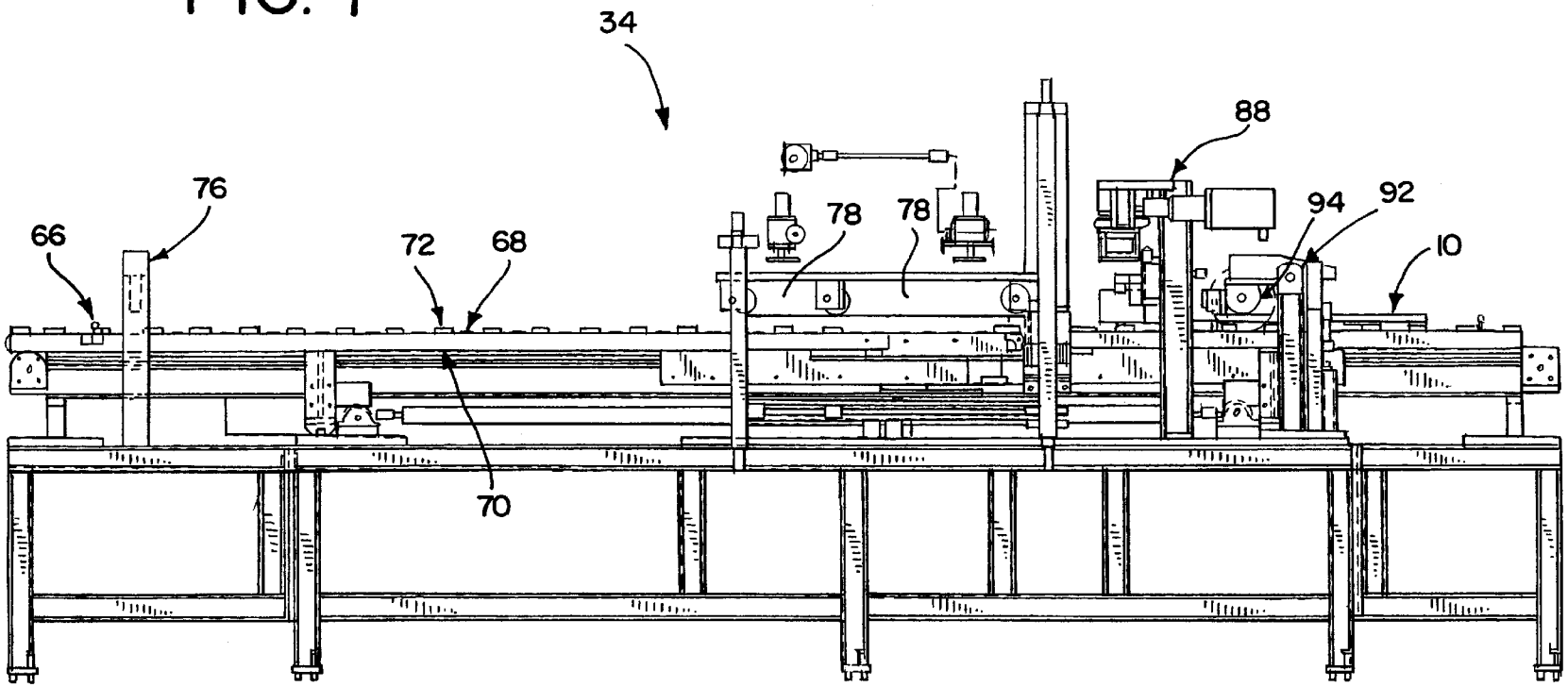
FIG. 7 is a side elevational view of the second station and the alternative fifth station.
Figure 8:
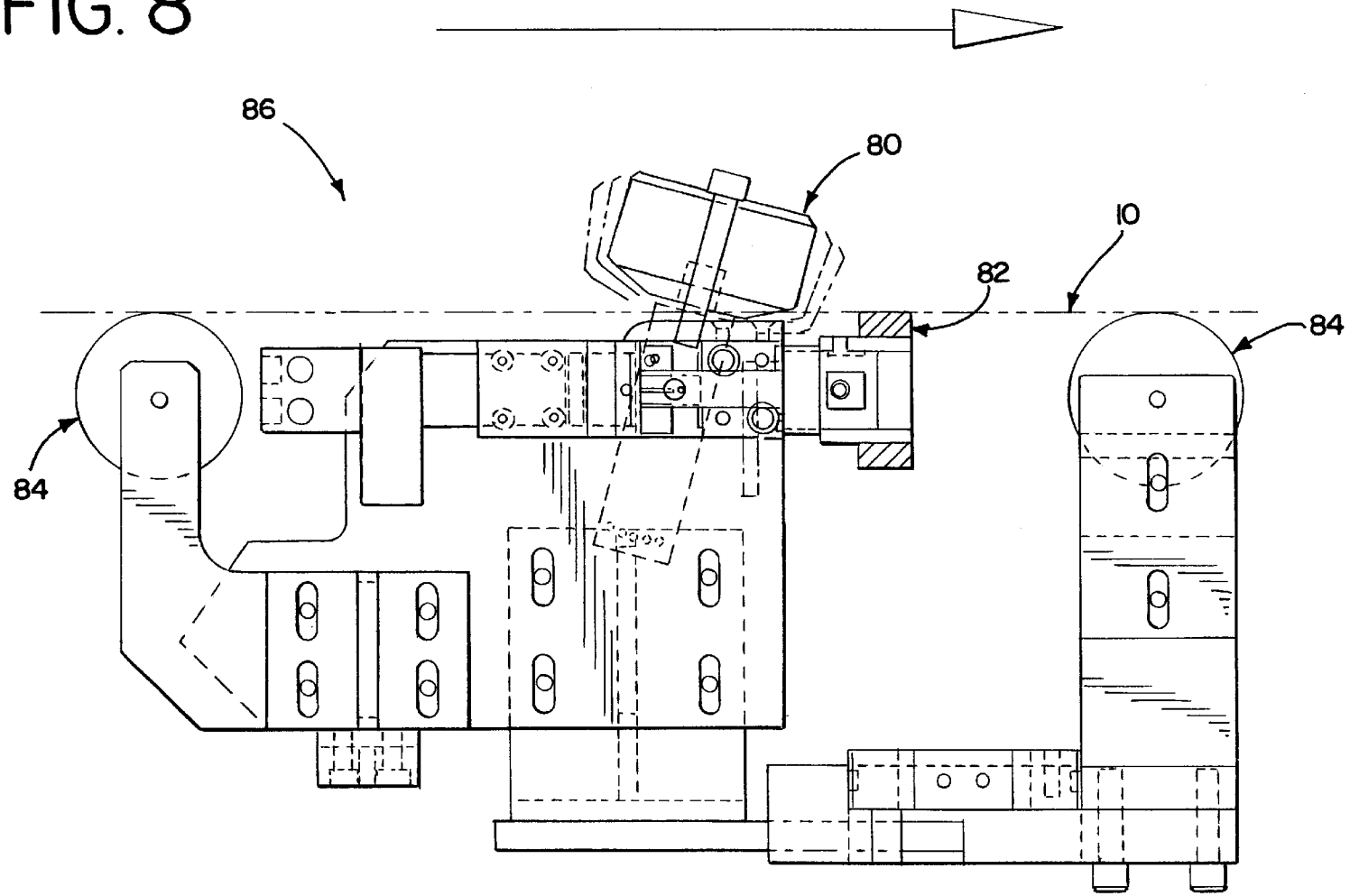
FIG. 8 is a top plan view of a side stapler used on the second station and the alternative fifth station.
Figure 9:
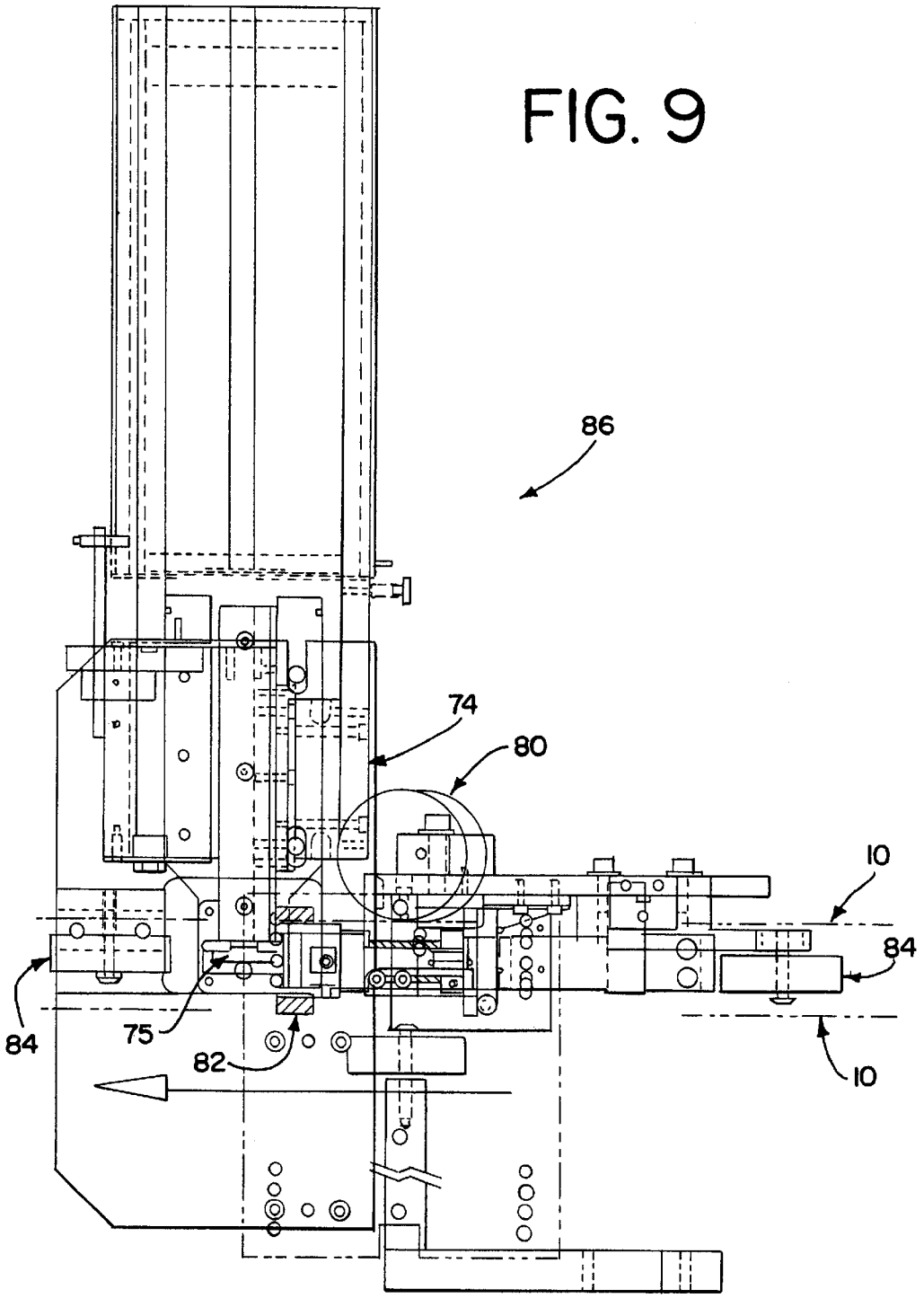
FIG. 9 is a side elevational view of the side stapler.
Figure 10:
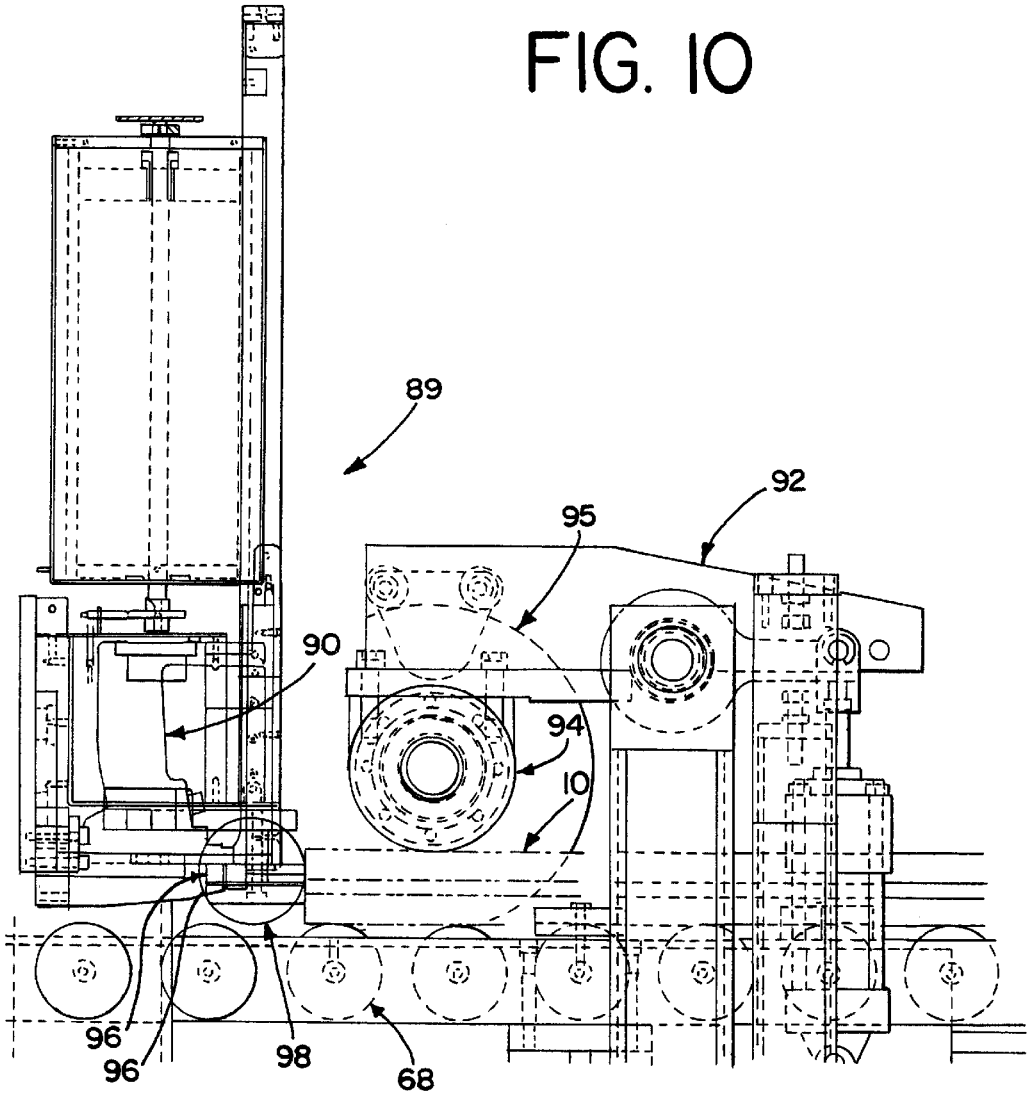
FIG. 10 is a side elevational view of a rear stapler used on the second station and the alternative fifth station.
Figure 11:
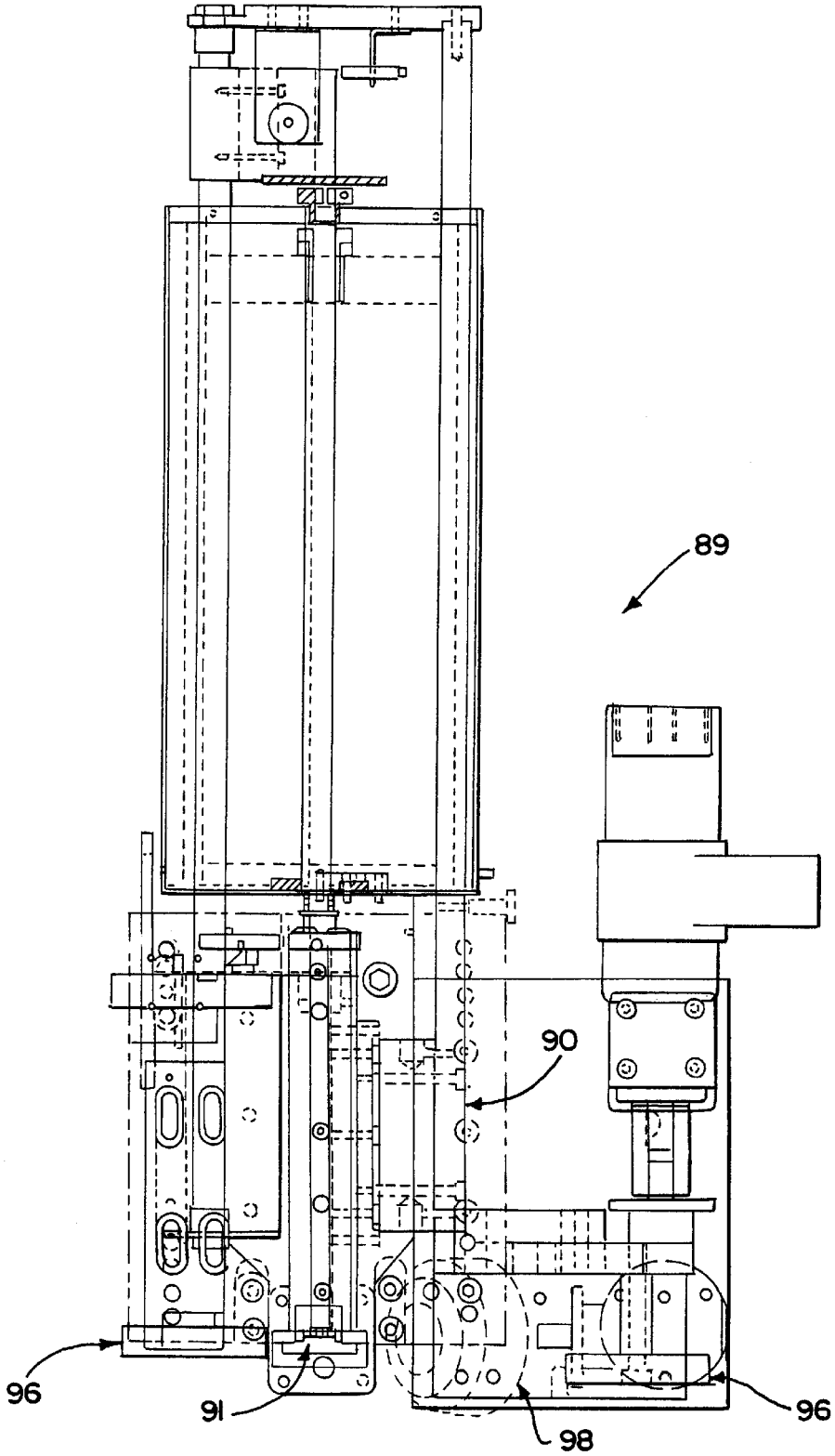
FIG. 11 is a front elevational view of the rear stapler.
Figure 12:
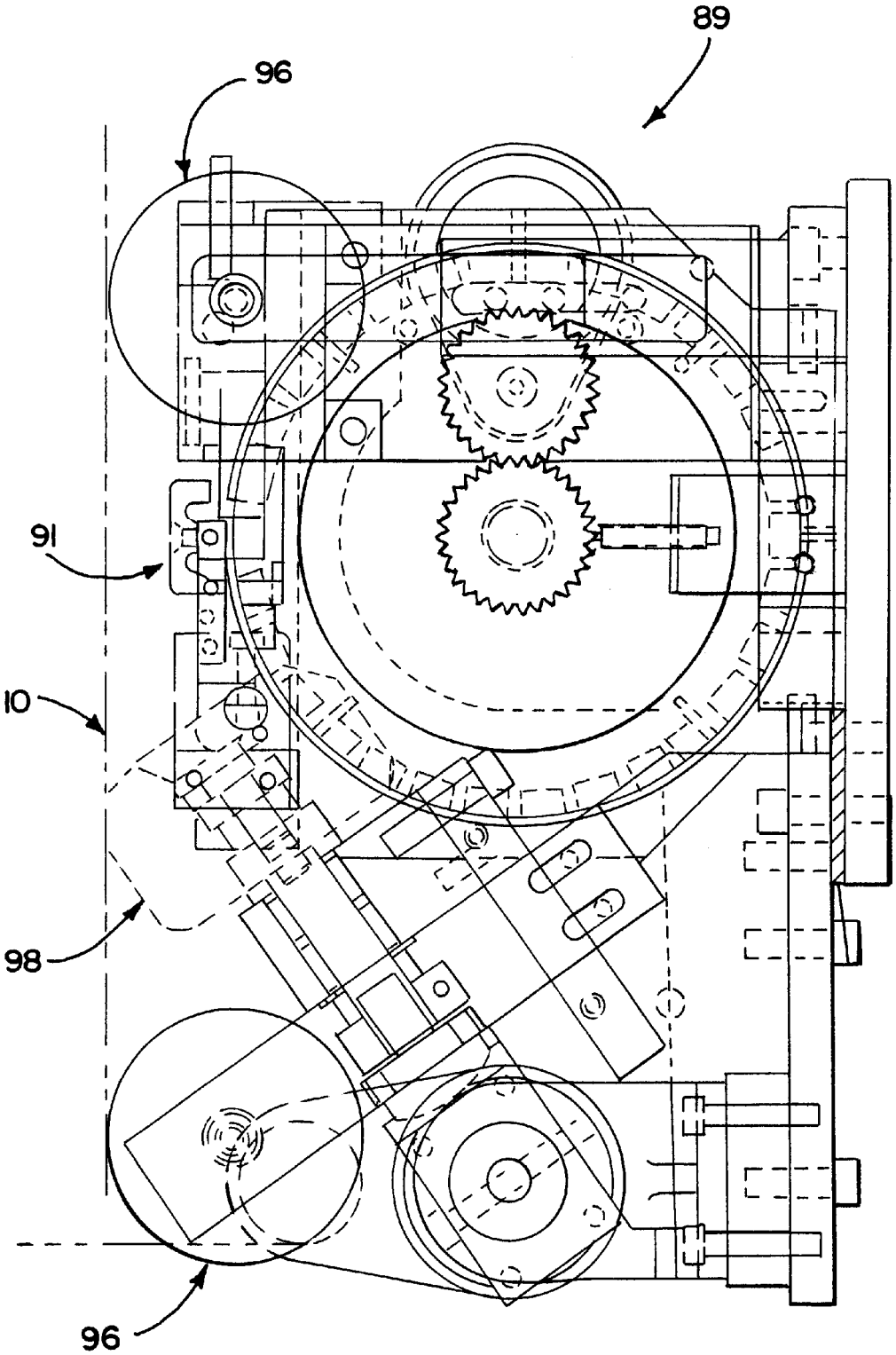
FIG. 12 is a top plan view of the rear stapler.
Figure 13:
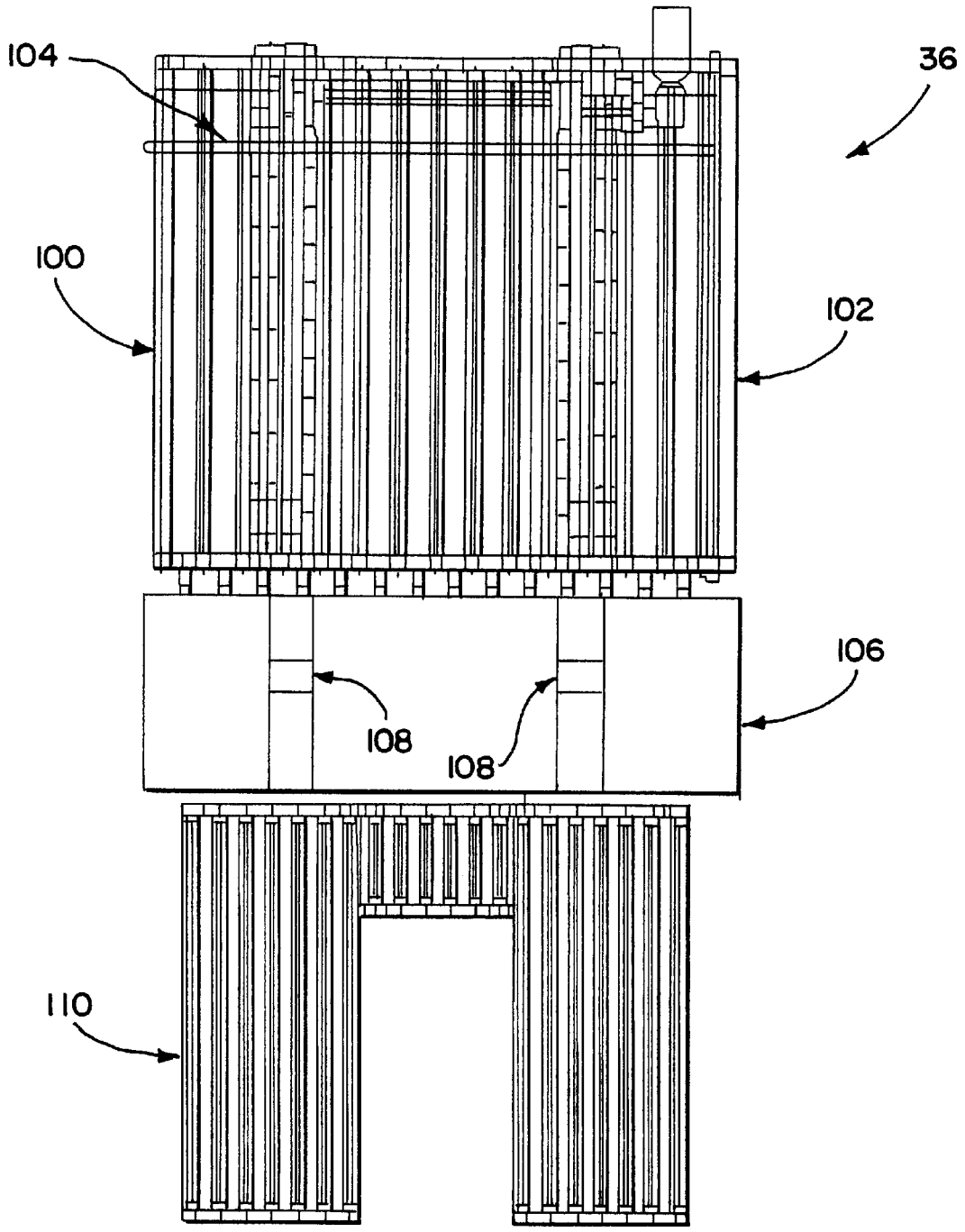
FIG. 13 is a top plan view of a third station.

Referring now to the drawings, a machine 30 is provided for manufacturing fabric panels 10. The machine 30 provides a more efficient manufacturing process by minimizing the amount of labor required to manufacture the panels 10. In addition, the machine 30 produces fabric panels with a higher quality than traditional manual processes. The machine 30 includes five stations 32, 34, 36, 38, 40 for attaching fabric 14 onto a core 12. Thus, after a core 12 has been processed through all five stations 32, 34, 36, 38, 40, the desired layers of fabric 14 will be attached to both the front side and back side of the panel 10. The machine 30 also stretches the fabric 14 to achieve the desired final stretch in the fabric.

Accordingly, the machine 30 is operated by loading a core 12 onto the first station 32. Preferably, two operators work at the first station 32, with one operator located on each side of the station 32. Any of the various types of panel cores that are well-known in the art can be used in the machine 30. Cores 12 with different thicknesses can also be used, although cores 12 with a single thickness of about 1.75 inch are preferred in order to minimize the number of adjustments required between different groups of panels 10. In addition, because customers demand panels with many different heights and widths, the machine 30 can accept cores 12 with various heights and widths, with only minimal adjustments necessary. For example, widths between at least 12 and 60 inches and heights between at least 24 and 80 inches are possible.

After the core 12 is placed on the first station 32, the side supports 50 are adjusted inward so that they abut against the sides of the core 12. The side supports 50 exert sufficient side pressure on the core 12 to resist the rearward force that will be applied by the front stapler 58. The adjustment of the side supports is simplified by a rack and pinion gear system (not indicated) that is controlled by a computer 42. Accordingly, the core 12 is positioned onto the first station 32 with the bottom side of the core 12 resting on the center rollers 52 and the side supports 50. The core 12 is also positioned against a raised guide stop 54 that extends along the width of the core 12 with the front surface of the core 12 abutting against the guide stop 54.

Next, the various layers 14 of fabric are laid on the top surface of the core 12. Typically, several different layers 14 are laid onto the core 12, with the multiple layers 14 being placed on top of each other. Common fabric layers 14 that are used include fire barriers 16, acoustical barriers 18, and outer layers 20. Thus, the operators will usually lay a fire barrier layer 16 on first, an acoustical barrier layer 18 next, and an outer fabric layer 20 last. The overall thickness of these layers is typically between 0.012 and 0.060 inch.

In order to increase the speed of placing the layers 14 onto the core 12, a guide system is provided for lining up the layers 14 from the edges of the layers 14. Accurate positioning of the layers 14 onto the core 12 is important to ensure that sufficient excess material is available around each side of the core 12 for stapling the layers 14. In addition, positioning of the outer fabric layer 20 is especially critical to satisfy quality demands for the appearance of the fabric panels 10. The outer layer 20 of the fabric 14 usually includes visible textile threads that are woven in vertical and horizontal directions. Naturally, consumers prefer the visible threads of the fabric panel 10 to extend straight, or parallel, with the edges of the panel 10. Commonly, a quality criteria of 3 to 7 threads, or 0.25 inch, of misalignment from an imaginary straight line across the panel 10 is considered acceptable. Traditionally, the layers 14 are visually lined up by the operators using the sides of the core 12 as a rough guide. Likewise, the outer fabric layer 20 is traditionally lined up by visually studying the location of the threads in the fabric 20 and roughly lining up these threads with the core 12.

The speed of this aligning operation is increased by precutting the fabric layers 14 in a separate operation. This allows the precut outer fabric layers 20 to be more accurately cut in relation to the threads in the fabric 20. Thus, the precut outer fabric layers 20 are preferably cut so that misalignment between the threads in the fabric 20 and the edges of the precut layer 20 is less than 0.5 inch. The operators are then able to quickly line up the edges of each layer 14 with the core 12 without referring to the threads in the outer fabric layer 20. Therefore, a marked line (not shown) is provided that extends across the entire width of the guide stop 54. Side marks (not shown) are also provided on the side supports 50. Thus, the operators can accurately position the layers 14 onto the core 12 by simply lining up the edges of the layers 14 with the front marked line on the guide stop 54 and the side marks on the side supports 50. If needed, tape can be used by the operators to temporarily secure the fabric 14 to the core 12.

Next, the front edge of the layers 14 is stapled to the front surface of the core 12. Before stapling, the operators actuate manual side clamps 56 near the front of the core 12 that grasp the fabric 14 and stretch the fabric 14 outwards. This step of stretching the fabric 14 along the front edge is necessary so that the front stapler 58 staples the fabric 14 in a stretched state that will match the fabric stretch that will be applied in the second station 34. By stretching the front edge of the fabric 14 during stapling, puckering, or loose fabric areas, is prevented around the front corners of the completed panel 10.

The front stapler 58 is mounted on an overhead frame 60 that allows the panel 10 to travel under and between the frame 60 to the second station 34 after stapling. The stapler 58 is mounted to the overhead portion of the frame 60 with springs that bias the stapler against the core and is powered by a belt and pulley system (not indicated) that allows the stapler 58 to traverse along the overhead portion. Therefore, when the operators press a start button, the computer 42 controls the stapler 58 and the stapler 58 traverses across the front surface of the core 12, stapling the layers 14 to the front surface of the core 12 as the stapler 58 traverses.

In order to correctly position the front edge of the fabric 14 for stapling, a front fabric guide 62 is provided which is attached to the stapler 58. The fabric guide 62 is preferably made from ultra high molecular weight polyethelene. The fabric guide 62 is mounted ahead of the staple opening 59 and is shaped in the form of an L-shape. Preferably, one leg of the L-shape is spring loaded to rest on the top surface of the core 12, and the other leg is positioned about 0.010 to 0.020 inch from the front surface of the core 12. Thus, as the stapler 58 staples the fabric layers 14 to the front surface of the core 12, the fabric guide 62 smoothly feeds the edges of the layers 14 over the top surface of the core 12 and down along the front surface of the core 12. The stapler 58 then staples the layers 14 to the front surface of the core 12 immediately after the fabric guide 62 positions the layers 14. Preferably, the staples 22 are stapled about 0.125 inch apart from each other.

Once the front stapler 58 has completed stapling the front surface, the computer 42 then releases the front manual clamps 56, moves the side supports 60 outward, and lowers the front guide stop 54. The front stapler 58 also moves to its starting point off to one side of the overhead frame 60 to allow clearance into the second station 34. The operators then staple the front side corners of the fabric layers 14 to the side surfaces of the core 12. Accordingly, the operators on each side of the panel 10 fold the side edge material down over the top surface of the core 12 near the front corner. Next, the operators fold the front edge material back along the side surface of the corner. The operators secure this corner edge material by stapling it with a single staple 22 to the front side surface of the core 12. To assist the operators with this corner stapling, cutaway sections 64 have been provided through the side supports 50 near the front corner of the core 12 to give the operators easier access to the side surface of the core 12.

The operators then load the panel 10 into the second station 34 by rolling the core 12 forward on the center rollers 52. In order to clear the drive ledge 66, the operators lift the core 12 slightly as they push the core 12 forward and over the drive ledge 66. Once the core 12 has passed the drive ledge 66, the operators release the core 12 and press a start button to begin the second station 34.

In the second station 34, the bottom surface of the core 12, rests on bottom rollers 68 attached to the side supports 70. The side supports 70 also include side rollers 72 that guide the side surfaces of the core 12. To accommodate cores 12 of different widths, the position of the side supports 70 and the side staplers 74 are adjustable and can be controlled by the computer 42. Accordingly, the drive ledge 66 feeds the panel 10 through the second station 34 by abutting against the rear surface of the core 12 and pushing the core forward. Preferably, the drive ledge is powered by a chain and pulley system (not indicated) that is controlled by the computer 42. A travel speed of about 0.83 feet per second of the drive ledge 66 through the second station 34 is preferred.

As the core 12 along with the fabric layers 14, move forward, a brush 76 engages the top surface of the panel 10 to prepare the fabric layers 14 for stretching and stapling. The brush 76 is positioned above and across the travel path of the panel 10 so that the bristles of the brush 10 contact the top surface of the panel 10 across its entire width. Thus, the brush 76 prepares the fabric layers 14 by smoothing and flattening the layers 14 and removing any wrinkles that might exist in the layers 14. Preferably, the bottom of the bristles of the brush 76 extend about 0.250 inch below the top surface of the core 12 to provide sufficient brushing force. A brush 76, such as a metal-backed conveyor strip brush with nylon fill and a trim length of 3 inches, has been shown to sufficiently smooth the fabric layers 14.

After the brush 76 prepares the fabric layers 14, a set of first rollers 78 stretches the fabric 14 across the width of the panel 10. The first rollers 78 are positioned above the travel path of the panel 10 in an angled or inverted V-shape. Preferably, two pairs of first rollers 78 are used, with a leading pair of rollers 78 engaging the fabric 78 before a following pair of rollers 78. Accordingly, each roller 78 extends from the center of the panel 10 to one side of the panel 10, with the side portion of the roller 78 engaging the fabric 14 before the center portion. The mating roller 78 in each pair extends from the center of the panel 10 near the mated roller 78 to the other side of the panel 10. Preferably, the included angle between the mating rollers 78 is about 110°. As is apparent now, the first rollers 78 pull the fabric 14 outward towards the sides of the panel 10 when the fabric 14 contacts the rollers 78.

The first rollers 78 are not powered and rotate instead due to friction that is created between the rollers 78 and the fabric 14. Preferably, for most fabric layers 14, the rollers 78 are positioned so that the bottom surface of the rollers 78 is about 0.010 inch above the top surface of the core 12. This setting generally results in a stretch of about 4% in the outer fabric layer 20. Alternatively, the first rollers 78 can be positioned about 0.010 inch above the top surface of the core 12. This setting generally results in a stretch of about 6% when flannel material is used for the outer fabric layer 20. In order to easily change the height setting of the first rollers 78, an adjustable height mechanism is provided which moves the rollers 78 up and down based on control signals from the computer 42. Preferably, the outer diameter of the rollers 78 is about 4 inches. An outer diameter formed from a foam material tends to provide an improved stretch of the fabric 14. A foam material like foam pipe insulation is preferred.

After the fabric 14 has been stretched by the first rollers 78, a pair of second rollers 80 further stretch the sides of the fabric 14. Accordingly, one second roller 80 is provided at each side of the panel 10 at a position behind the first rollers 78. To maximize the stretch of the fabric 14 at the staple opening 75, the second rollers 80 are directly mounted to each of the side staplers 74 and are positioned slightly ahead of the staple opening 75. Like the first rollers 78, the second rollers 80 are angled to pull the fabric outward. Thus, the second rollers 80 engage the side of the fabric 14 along the top surface of the core 12 and stretch the fabric 14 towards the stapler 74.

The second rollers 80 are not powered and are rotated by friction created between the rollers 80 and the fabric 14.

Preferably, the second rollers 80 are angled about 75° from the incoming center line of the panel 10. The rollers 80 are also preferably positioned so that they ride along the top of panel 10, thus creating friction with the fabric 14. A roller 80, such as a 2.45 inch diameter urethane roller, has been shown to sufficiently stretch the fabric 14.

A pair of third rollers 82 provide the final stretch in the fabric 14 before the side staplers 74 staple the fabric 14 to the core 12. Each of the third rollers 82 is directly mounted to each of the side staplers 74 at a position between the second roller 80 and the staple opening 75. Unlike the first 78 and second 80 rollers, the third rollers 82 are positioned along the side surface of the panel 10 with their axes of rotation parallel to the center line of the panel 10. Therefore, the third rollers 82 engage the outer edges of the fabric 14 and pull the fabric 14 down over the top surface and along the side surfaces of the core 12.

The third rollers 82 are powered by pneumatic motors so that they rotate about 1,000 rpm. Preferably, the rollers 82 are positioned about 0.25 inch from the fabric layers in order to create adequate friction with the fabric 14. A roller 82 like that manufactured by the company E&EB under the model number EER-2020-60UR-EX10 has been shown to sufficiently stretch the fabric 14.

After the third rollers 82 completely stretch the fabric 14, the side staplers 74 staple the fabric layers 14 to the core 12 along the side surfaces of the panel 10. Because the thickness of the fabrics 14 that are used vary for different panel 10 configurations, the side staplers 74 are mounted to the side supports 70 with springs. Thus, the position of the side staplers 74 is fixed in a longitudinal direction, and the side staplers 74 are laterally biased against the side surfaces of the panel 10 by the springs. To provide the desired positioning of the stapler 74 from the fabric layers 14, two guide rollers 84 are attached to each of the stapler assemblies 86, with one guide roller 84 positioned ahead of the third roller 82 and the other guide roller 84 positioned behind the staple opening 75. Therefore, the stapler assemblies 86 are biased against the side surfaces of the panel 10, with the guide rollers 84 rotating freely against the side surfaces of the panel 10 and positioning the stapler assemblies 86 relative to the fabric layers 14. Preferably, the opening 75 of the stapler 74 is positioned about 0.125 inch from the contact surface of the guide rollers 84 to provide an adequate stapling position. As noted before, the second rollers 80 and the third rollers 82 are also mounted to the stapler assemblies 86. Thus, the lateral position of the second 80 and third 82 rollers also varies based on the thickness of the fabric layers 14.

Accordingly, as the panel 10 travels through the second station 34, the side staplers 74 staple the stretched fabric layers 14 to the side surfaces of the core 12. Preferably, a proximity sensor (not shown) is provided that senses when the panel 10 is adjacent to the staple opening 75. The computer 42 then activates the side staplers 74 at the appropriate times so that the staplers 74 staple the entire length of the panel 10. Typically, a spacing of 0.125 inch between the staples 22 is preferred.

After the panel 10 travels past the side staplers 74, the panel 10 passes under an overhead frame 88 that supports the rear stapler 90. Another overhead frame 92, which supports a brake 94, is positioned behind the rear stapler 90. The brake 94 is a roller that contacts the top surface of the fabric layers 14 to provide resistance to the forward force of the rear stapler 90. The brake 94 is not powered and extends across the width of the panel 10. Preferably, the diameter of the brake 94 is about 4 inches. An outer diameter formed from a foam material about 0.5 inch thick of non-marking rubber coating (about 26 A durometer) generally provides improved contact between the brake 94 and the fabric 14. In addition, the bottom contact surface of the brake 94 is preferably positioned so that the brake 94 firmly rides along the top of the panel 10.

Thus, as the panel 10 travels under the brake 94, the brake 94 rolls along the top surface of the panel 10 and creates some drag force on the panel 10 as the panel 10 travels through the second station 34. When the rear surface of the core 12 reaches the rear stapling position, the rotation of the brake 94 is stopped by a braking mechanism 95 and the forward motion of the drive ledge 66 is halted. Preferably, a disk brake assembly 95 is provided as the braking mechanism 95. Therefore, when the braking mechanism 95 stops the brake's 94 rotation, the contact friction between the brake 94 and the panel 10 prevents the panel 10 from moving forward.

The rear stapler 90 then traverses across the width of the panel 10 and staples the rear edge of the fabric layers 14 to the rear surface of the core 12. The stapler 90 is initially positioned off to one side of the panel 10 to allow the panel 10 to travel under the overhead frame 88, and a chain and sprocket drive assembly is provided in the overhead frame 88 for traversing the stapler 90 across the width of the panel 10. Like the side staplers 74, the rear stapler 90 is mounted on springs in order to position the stapler 90 next to the panel 10 during stapling. Guide rollers 96 are also provided, with one roller 96 positioned on each side of the staple opening 91 to keep the stapler 90 at the desired stapling position. Thus, the stapler 90 is biased against the rear surface of the panel 10, and the guide rollers 96 roll against the rear edge of the fabric 14 as the stapler 90 traverses. Preferably, the opening 91 of the stapler 90 is positioned about 0.125 inch from the contact surface of the guide rollers 96 to provide an adequate stapling position.

A rear roller 98 is also provided that stretches the fabric layers 14 down from the top surface of the core 12. The rear roller 98 is mounted to the rear stapler assembly 89 and is positioned between the leading guide roller 96 and the staple opening 91. The rear roller 98 is powered by a pneumatic motor so that as it rotates and contacts the fabric 14, the roller 98 pulls and stretches the fabric. The rotational speed of the roller 98 is about 475 rpm. In order to fit the rear roller 98 closely to the staple opening 91 and the leading guide roller 96, the roller 98 is oriented in an angle, with the axis of rotation of the roller 98 being acutely angled outward about 35° from the trailing guide roller 96. To correspond to the angular orientation of the rear roller 98, the front corner of the rear roller 98 is trimmed flat to provide a parallel contact surface about 0.41 inch wide between the rear roller 98 and the fabric 14. Preferably, a roller 98, such as a 2.45 inch diameter urethane roller, can be used for the rear roller 98.

Accordingly, the rear stapler 90 traverses across the width of the panel 10 and staples the fabric 14 to the rear surface of the core 12 after the fabric 14 is stretched by the rear roller 98. Preferably, the spacing between the staples 22 is about 0.125 inch. After the stapler 90 has completed stapling, the braking mechanism 95 releases the brake 94, and the drive ledge 66 resumes its forward motion.

After exiting the second station 34, the fabric layers 14 are completely affixed to the top surface of the core 12. Generally, however, fabric 14 is desired on both sides of the core 12. Therefore, two comparable stations 38, 40 are provided for attaching fabric layers 14 to the bottom surface of the core 12. In order to further automate the process of attaching fabric 14 to the bottom surface of the core 12, the comparable stations 38, 40 are positioned behind the exit of the second station 34. Thus, the fourth station 38, which is comparable to the first station 32, is positioned so that the fourth station 38 receives the panel 10 after exiting the second station 34.

To automate the transfer between the second station 34 and the fourth station 38, a third station 36 directly links the second 34 and fourth 38 stations together. Accordingly, the third station 36 turns the panel 10 over so that the bottom surface of the core 12 faces upward, thereby becoming the next top surface for the fourth 38 and the fifth 40 stations. A section of powered conveyor rollers 100 move the panel 10 into the third station 36 from the second station 34 until the front surface of the panel 10 abuts against a stop 102. A side loading member 104 then pushes the panel 10 towards a flipping member 106 by abutting against the side of the panel 10 opposite the flipping member 106. The flipping member 106 receives the panel 10 in an open slot 108 that is initially oriented horizontal. Once the side of the panel 10 fully enters the slot 108 in the flipping member 106, a proximity sensor (not shown) senses the presence of the panel 10 and the flipping member 106 begins to rotate upward. Preferably, the flipping member 106 is driven by a circular gear rack and a gear pinion (not indicated). To ensure the safety of the operators, the computer 42 stops the rotation of the flipping member 106 when the slot 108 and the panel 10 is oriented vertically upward.

When the operators of the fourth station 38 are ready to begin another panel 10, the operators press a button which rotates the flipping member 106 another 900 towards a section of non-powered conveyor rollers 110. The non-powered conveyor rollers 110 are positioned in line with the fourth 38 and fifth 40 stations so that the operators can then roll the panel 10 into the fourth station 38. After the operators remove the panel 10 from the flipping member 106, and the proximity sensor in the flipping member 106 senses the absence of the panel 10, the flipping member 106 rotates back 180° to receive another panel 10.

The fourth 38 and fifth 40 stations are comparable to the first 32 and second 34 stations, respectively. Thus, in the fourth station 38, another pair of operators place fabric layers 14 on the top surface of the core 12. The front edge of the fabric layers 14 are then stapled to the front surface of the core 12. In the fifth station 40, like the second station 34, the side edges of the fabric 14 are stapled to the side surfaces of the core 12, and the rear edge of the fabric 14 is stapled to the rear surface of the core 12. Therefore, when the panel 10 exits the fifth station 40, the desired fabric layers 14 will be attached to both sides of the core 12. One advantage of providing the fourth 38 and fifth 40 stations is that the settings of the fourth 38 and fifth 40 stations can vary from the settings used in the first 32 and second 34 stations in order to account for the height of the fabric 14 that is already attached to the bottom surface of the panel 10. Accordingly, the height settings may differ for the fourth 38 and fifth 40 stations, with the brush 76, the first rollers 78, the side staplers 74, the rear stapler 90, and the brake 94, preferably being positioned about 0.012 to 0.060 inch higher in the fourth 38 and fifth 40 stations than the corresponding components in the first 32 and second 34 stations.

While a preferred embodiment of the invention has been described, it should be understood that the invention is not so limited, and modifications may be made without departing from the invention. The scope of the invention is defined by the appended claims, and all devices that come within the meaning of the claims, either literally or by equivalence, are intended to be embraced therein.

I claim:

1. A machine for securing fabric to a core comprising: a support adapted to support said core, a first roller disposed adjacent said support, said first roller adapted to stretch said fabric over said core, a stapler positioned adjacent said support, said stapler adapted to staple said fabric to said core, wherein said first roller is disposed above said support thereby being adapted to stretch said fabric over a top surface of said core towards a side surface of said core and said stapler is positioned along a side of said support thereby being adapted to staple said fabric to a side surface of said core, and further comprising two of said first roller oriented in a V-shape and mounted to an overhead frame, wherein each roller extends from a center location above said support to opposite sides of the overhead frame with a side-positioned portion of each roller engaging said fabric before a center-positioned portion of each roller.

2. The machine according to claim 1 further comprising a drive ledge moveable through said machine and adapted to abut a rear surface of said core thereby pushing said core through the machine.

3. The machine according to claim 2 wherein said drive ledge moves at a speed about 0.83 feet per second.

4. The machine according to claim 1 further comprising a brush disposed above said support adapted to engage and remove wrinkles from said fabric.

5. The machine according to claim 4 wherein said brush is nylon with a trim length about three inches.

6. The machine according to claim 1 wherein said first rollers are free-spinning.

7. The machine according to claim 6 wherein a bottom of said first rollers is positioned about 0.010 inch above said top surface of said core.

8. The machine according to claim 7 wherein said bottom of said first rollers is adjustable to a position about 0.010 inch above said top surface of said core.

9. The machine according to claim 7 wherein said first rollers comprise a foam pipe insulation along an outer diameter about 4 inches.

10. The machine according to claim 1 wherein said first rollers comprise a foam pipe insulation along an outer diameter about 4 inches.

11. The machine according to claim 1 wherein a included angle between said first rollers is about 110°.

12. The machine according to claim 1 further comprising a second roller disposed above said support adapted to engage said fabric along said top surface of said core and near said side surface of said core.

13. The machine according to claim 12 further comprising two of said second roller, wherein each roller is disposed along opposite sides of said core and are oriented with their axes of rotation angled acutely from an incoming center line of said core.

14. The machine according to claim 13 wherein said second rollers are free spinning, said second rollers being urethane about 2.45 inch in diameter.

15. The machine according to claim 14 wherein said acute angle is about 75°.

16. The machine according to claim 1 further comprising a third roller disposed along a side of said support adapted to engage said fabric along said side surface.

17. The machine according to claim 16 further comprising two of said third roller, wherein each roller is disposed along opposite sides of said core and the rollers are oriented with their axes of rotation parallel to said side surface of said core.

18. The machine according to claim 17 wherein said third rollers are powered by a motor.

19. The machine according to claim 18 wherein said third rollers are rotated about 1,000 revolutions per minute and are positioned with a side contact surface about 0.25 inch from said side surface of said core.

20. The machine according to claim 1 wherein said side stapler is biased against said side surface and is positioned relative to the side surface by guide rollers.

21. The machine according to claim 20 wherein said side stapler is fixed in the direction of travel of said core, thereby stapling said fabric to said side surface of said core as the core travels by the side stapler.

22. The machine according to claim 1 further comprising a rear stapler disposed behind said side stapler, wherein said rear stapler is mounted to an overhead frame.

23. The machine according to claim 22 further comprising a brake capable of resisting a forward stapling force applied to said core by said rear stapler.

24. The machine according to claim 23 wherein said brake is a roller mounted to an overhead frame, said roller extending across said top surface of said core thereby engaging said fabric, rotation of said brake being stoppable by a brake mechanism.

25. The machine according to claim 24 wherein said brake comprises a rubber coating along an outer diameter about 4 inches.

26. The machine according to claim 22 further comprising a rear roller mounted to said rear stapler adapted to engage said fabric along a rear surface of said core.

27. The machine according to claim 26 wherein said rear roller is powered by a motor and is urethane about 2.45 inch in diameter.

28. The machine according to claim 27 wherein said rear roller is disposed ahead of said stapler in the direction of stapling, the roller being oriented with its axis of rotation angled acutely outward from said rear stapler, and a front corner of the roller being trimmed at an angle thereby providing a parallel contact surface.

29. The machine according to claim 28 wherein said rear roller rotates about 475 revolutions per minute.

30. The machine according to claim 22 wherein said rear stapler is biased against a rear surface of said core and is positioned relative to said rear surface by guide rollers.

31. The machine according to claim 30 wherein said rear stapler traverses across the width of said core, thereby stapling said fabric to said rear surface of said core.

32. The machine according to claim 1 further comprising a front stapler disposed ahead of said first roller, wherein said front stapler is mounted to an overhead frame which said core can travel under.

33. The machine according to claim 32 further comprising a fabric guide mounted to said front stapler, wherein said fabric guide is L-shaped with one leg adapted to engage said fabric along said top surface of said core and the other leg adapted to engage said fabric along a front surface of said core.

34. The machine according to claim 33 wherein said fabric guide is ultra high molecular weight polyethylene, said top surface leg being spring loaded to rest on said top surface of said core and said front surface leg being positioned about 0.035 inch from said front surface of said core.

35. The machine according to claim 33 wherein said front stapler traverses across the width of said core, thereby stapling said fabric to said front surface of said core.

36. The machine according to claim 35 further comprising a clamp adapted to stretch said fabric along said front surface.

37. The machine according to claim 1 further comprising a guide stop adapted to abut a front surface of said core, said guide stop comprising a marked line and said support comprising side marks, wherein said fabric can be located on said core by aligning the fabric with said marked line and said side marks.

38. The machine according to claim 1 further comprising a flipping member with a slot adapted to receive a side of said core, said flipping member being rotatable thereby turning said core over.

39. The machine according to claim 1 wherein said first rollers are free spinning; and further comprising two third rollers disposed along a side of said support adapted to engage said fabric along said side surface, wherein each roller is disposed along opposite sides of said core and the rollers are oriented with their axes of rotation parallel to said side surface, said third rollers being powered by a motor.

40. The machine according to claim 39 further comprising two of said side stapler, wherein each stapler is disposed along opposite sides of said core, said side stapler being biased against said side surface and being positioned relative to the side surface by guide rollers, wherein said side stapler is fixed in the direction of travel of said core thereby stapling said fabric to said side surface of said core as the core travels by the side stapler.

41. The machine according to claim 39 further comprising a rear stapler disposed behind said side stapler, wherein said rear stapler is mounted to an overhead frame; and a rear roller mounted to said rear stapler adapted to engage said fabric along a rear surface of said core, wherein said rear roller is powered by a motor.

42. The machine according to claim 41 further comprising a front stapler disposed ahead of said first roller, wherein said front stapler is mounted to an overhead frame; and a fabric guide mounted to said front stapler, wherein said fabric guide is L-shaped with one leg adapted to engage said fabric along said top surface of said core and the other leg adapted to engage said fabric along a front surface of said core.

43. The machine according to claim 42 further comprising a brake adapted to resist a forward stapling force applied to said core by said rear stapler, wherein said brake is a roller mounted to an overhead frame, said roller extending across said top surface of said core thereby engaging said fabric, rotation of said brake being stoppable by a brake mechanism; and a guide stop adapted to abut a front surface of said core, said guide stop comprising a marked line and said support comprising side marks, wherein said fabric can be located on said core by aligning the fabric with said marked line and said side marks.

44. The machine according to claim 1 further comprising a flipping member adapted to receive said core, said flipping member being rotatable thereby turning said core over; said first roller and said side stapler comprising a first station for securing said fabric to one side of said core, said flipping member being disposed at an exit of said first station; and further comprising a second station comprising a comparable first roller and a comparable side stapler, said second station receiving said core from said flipping member thereby being adapted to stretch and staple said fabric to the other side of said core.

45. The machine according to claim 44 wherein said first rollers of said first station and said second station are free spinning; said first station and said second station each further comprise two second rollers disposed above said support adapted to engage said fabric along said top surface of said core and near said side surface of said core, wherein said second rollers are disposed along opposite sides of said core and are oriented with their axes of rotation angled acutely from the incoming center line of said core, said second rollers being free spinning; and said first station and said second station each further comprise two third rollers disposed along a side of said support adapted to engage said fabric along said side surface, wherein said third rollers are disposed along opposite sides of said core and are oriented with their axes of rotation parallel to said side surface of said core, said third rollers being powered by a motor.

46. The machine according to claim 45 wherein said first station and said second station each further comprise a rear stapler disposed behind said side stapler, wherein said rear stapler is mounted to an overhead frame, a rear roller being mounted to said rear stapler adapted to engage said fabric along a rear surface of said core, wherein said rear roller is powered by a motor; and said first station and said second station each further comprise a front stapler disposed ahead of said first roller, wherein said front stapler is mounted to an overhead frame, a fabric guide being mounted to said front stapler, wherein said fabric guide is L-shaped with one leg adapted to engage said fabric along said top surface of said core and the other leg adapted to engage said fabric along a front surface of said core.

47. A machine for securing fabric to a core comprising: a core, a fabric adapted to be secured to said core, a support adapted to support said core, two top rollers disposed above said support adapted to engage and stretch said fabric along a top surface of said core towards side surfaces of said core, wherein each roller is disposed along opposite sides of said core and the rollers are oriented with their axes of rotation angled acutely from the incoming center line of said core, said top rollers being free spinning; and two side rollers disposed along sides of said support adapted to engage and stretch said fabric along said side surfaces, wherein each roller is disposed along opposite sides of said core and the rollers are oriented with their axes of rotation parallel to said side surfaces of said core, said side rollers being powered by a motor.

48. A method of manufacturing a fabric panel comprising: supporting a core; placing a fabric on a top surface of said core; moving said core under a pair of top rollers, wherein said top rollers are disposed in an inverted V-shape with an outer end of each roller engaging said fabric before an inner end of each roller, said top rollers being free spinning; rotating a pair of side rollers, wherein said rollers are disposed along opposite sides of said core with their axes of rotation being parallel to side surfaces of said core thereby engaging said fabric; and securing said fabric to said side surfaces of said core after said top rollers and said side rollers stretch said fabric thereby preserving said stretch.

49. The method according to claim 48 further comprising: precutting said fabric with a misalignment of less than 0.500 inch between threads in the fabric and an edge of the fabric, wherein said placing comprises aligning said fabric to said core by lining said edge of the fabric with a guide abutting a surface of said core.

50. The method according to claim 49 further comprising: stretching a front edge of said fabric after said placing and securing said front edge to a front surface of said core.

* * * * *